US005370106A

United States Patent [19]

Beck et al.

[11] Patent Number: 5,370,106

[45] Date of Patent: Dec. 6, 1994

[54] SUPPORT FOR FURNACE HEAT EXCHANGER

[76] Inventors: Scott A. Beck, 10845 Bellefontaine, Indianapolis, Ind. 46280; Rex R. Mills, 5710 Pennsylvania, Indianapolis, Ind. 46220; Paul J. Otts, 145 West St., Plainfield, Ind. 46168; Larry D. Rieke, 1550 Village Walk Dr., Zionsville, Ind. 46077; Robert C. Swilik, Jr., 7419 Bramblewood La., Indianapolis, Ind. 46254

[21] Appl. No.: 149,901

[22] Filed: Nov. 10, 1993

[51] Int. Cl.[5] ..... F24H 3/02

[52] U.S. Cl. ..... 126/110 R

[58] Field of Search ..... 126/110 VR, 110 AA, 126/116 R, 116 B

[56] References Cited

U.S. PATENT DOCUMENTS 4,738,307 4/1988 Bentley ..... 126/110 R

*Primary Examiner*—Carroll B. Dority

[57] ABSTRACT

In a furnace of the type having a blower shelf with a blower attached to one surface thereof and a heat exchanger unit located proximate a second surface thereof, and the heat exchanger unit being reversibly attachable to the blower shelf, the improvement comprising: a retaining structure unitary with the back panel of the heat exchanger; and a structure which mates with the retaining structure and is unitary with the blower shelf. The retaining structure and mating structure function jointly to retain the back panel of the heat exchanger unit perpendicular to and proximate the blower shelf.

5 Claims, 6 Drawing Sheets

SUPPORT FOR FURNACE HEAT EXCHANGER

BACKGROUND OF THE INVENTION

1. Field of the Invention

This invention relates to a heat exchanger for a furnace, and is more particularly directed to a heat exchanger assembly for a furnace that is affixed to the blower shelf without the use of hardware.

2. Description of the Prior Art

In a functioning furnace it is desirable to maintain a separation of certain of the furnace components. In particular, in assignee's multi-poise furnace, a blower shelf extends outward from the back panel of the furnace heat exchanger assembly. The blower is suspended from this shelf and the condensing heat exchangers are located within the heat exchanger assembly situated on the opposite side of the blower shelf.

In the prior art upflow model of condensing furnace, a slide was screwed to the blower shelf, and the heat exchanger assembly in turn slipped into this slide.

It is therefore desirable to provide a shelf that can be seated in place or removed without the need of additional hardware such as screws, nuts and bolts or the like. That is it is desirable that the means for retaining the shelf in relation to the back panel of the heat exchanger should be unitary with the two parts to be connected. Furthermore, because the multi-poise furnace may be installed in any one of four possible orientations (two vertical and two horizontal), it is necessary that the shelf attachment remain functional in any of these positions. It is also necessary that the attachment be a stable one in that the heat exchanger unit be restrained from either side to side motion, or motion in a vertical direction either in use or during transportation of the furnace.

SUMMARY OF THE INVENTION

It is therefore a primary object of the present invention to provide a blower shelf that can be easily attached to or detached from the heat exchanger assembly of a furnace.

It is a further object of this invention to provide a blower shelf that can be attached to the heat exchanger assembly of a furnace using a minimum amount of extraneous hardware.

It is still a further object of this invention to provide a blower shelf that will remain attached to the heat exchanger assembly of a furnace regardless of the orientation of the furnace, without the use of extraneous hardware.

It is yet a further object of this invention to provide a, attachment for a blower shelf and heat exchanger assembly of a furnace which will restrain the heat exchanger assembly from vertical and side to side motion.

These and other objects of the present invention are attained by, in a furnace of the type having a blower shelf with a blower attached to one surface thereof and a heat exchanger unit located proximate a second surface thereof, and the heat exchanger unit being reversibly attachable to the blower shelf, the improvement comprising: a retaining structure unitary with the back panel of the heat exchanger; and a structure which mates with the retaining structure and is unitary with the blower shelf. The retaining structure and mating structure function jointly to retain the back panel of the heat exchanger unit perpendicular to and proximate the blower shelf.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
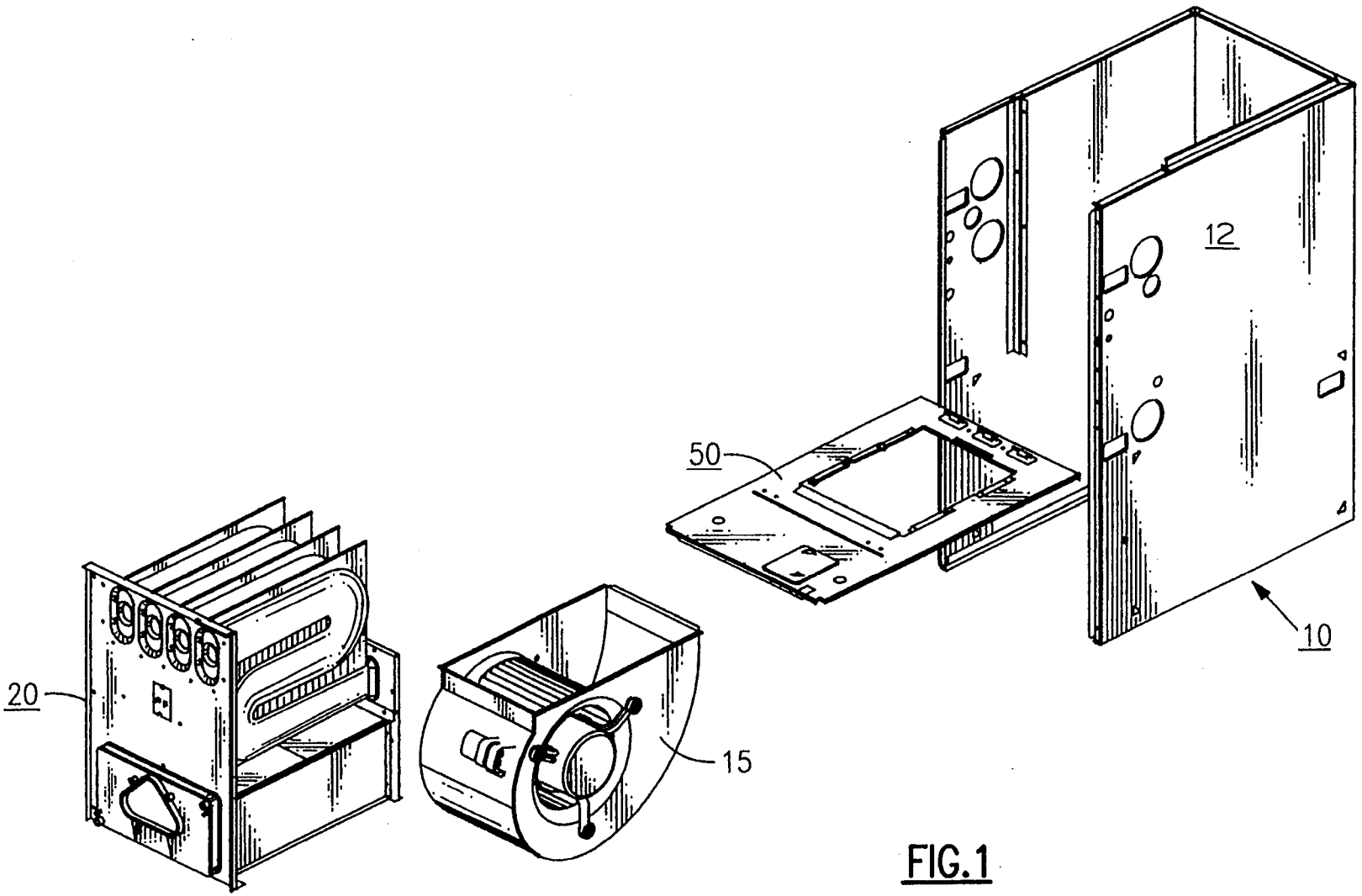
FIG. 1 is an exploded perspective view of the relevant portions of the furnace of the instant invention.

Turning now to the Drawing and particularly, FIG. 1 thereof, there is seen a multi-poise furnace labelled generally 10. The furnace 10 is housed in a cabinet 12 which is capable of being installed in either vertical upflow or downflow or a horizontal left-flow or horizontal right-flow orientation. When situated as shown in FIG. 1 with the top uppermost (and the blower directing air upward) the orientation is upflow. A reversal of 180° with the blower directing air downward is the downflow orientation. In the vertical up or upflow orientation, as shown in FIG. 1, a blower shelf 50 is located in a horizontal orientation at a position about one-third of the way from the floor or bottom of the furnace. Suspended from the blower shelf 50 is the blower 15, while positioned above the blower shelf 50 is the heat exchanger and panel assembly 20.

Figure 2:
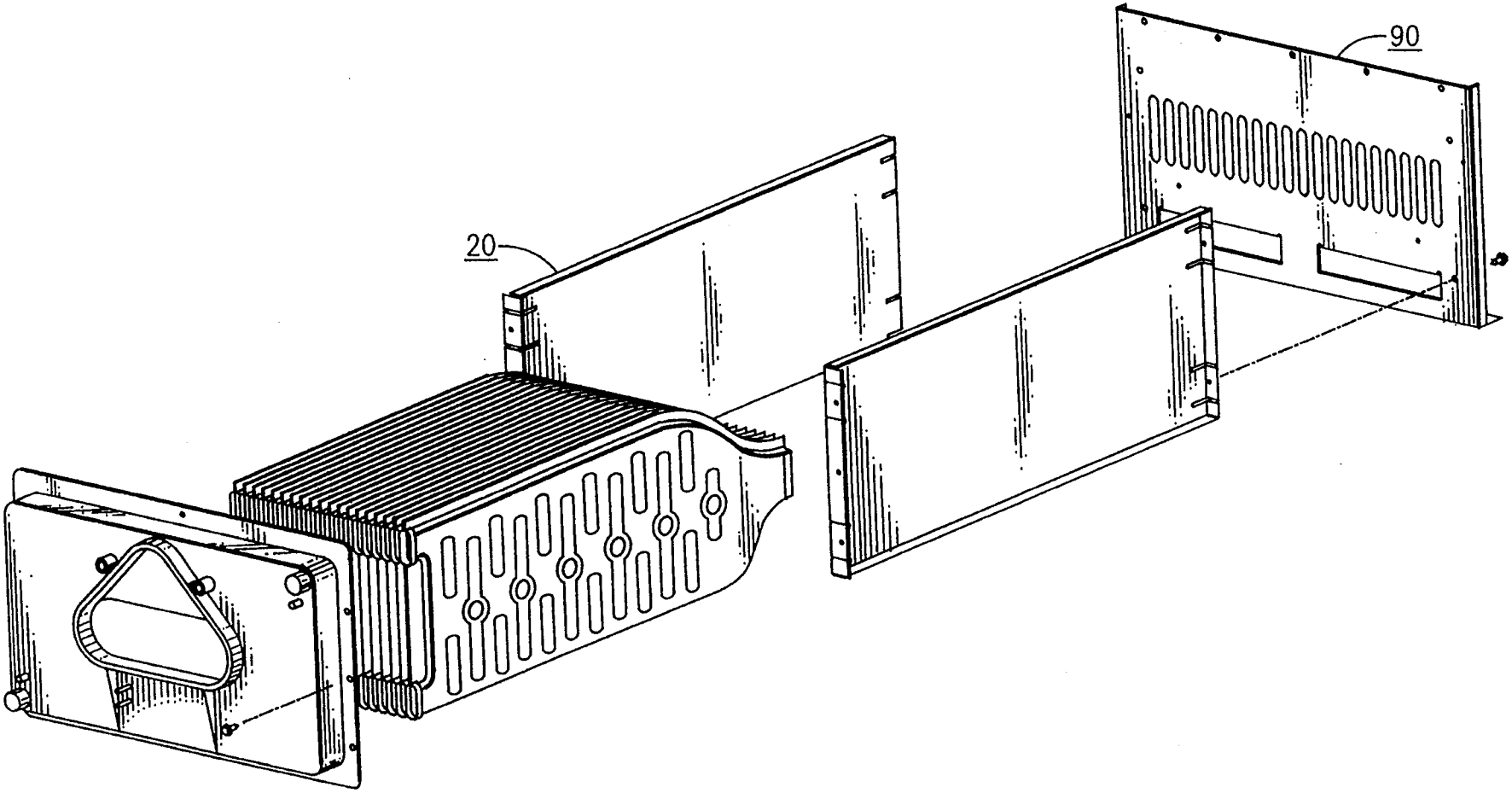
FIG. 2 is an exploded perspective view of the heat exchanger assembly.
Figure 3:
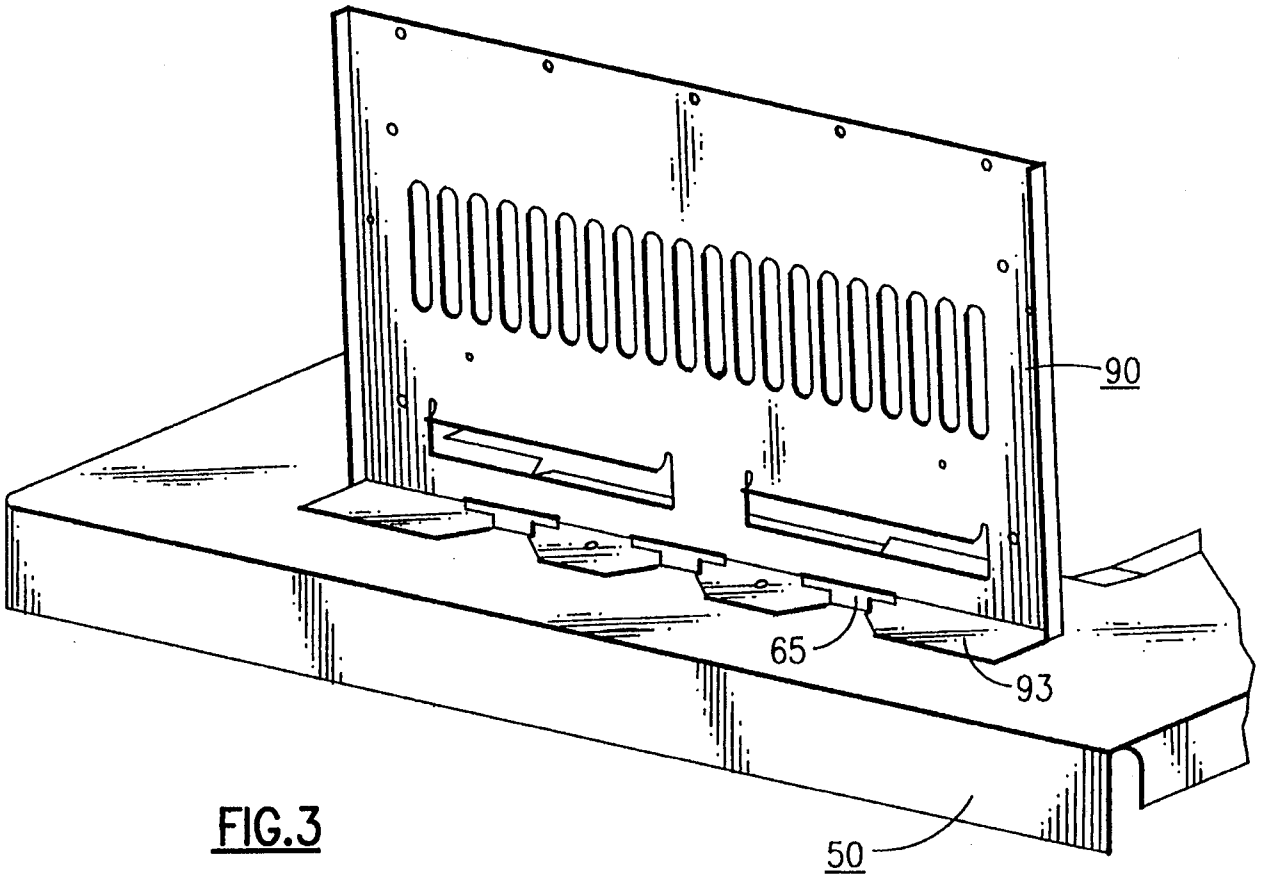
FIG. 3 is a view of the instant invention showing the blower shelf attached from the heat exchanger assembly back panel.
Figure 4:
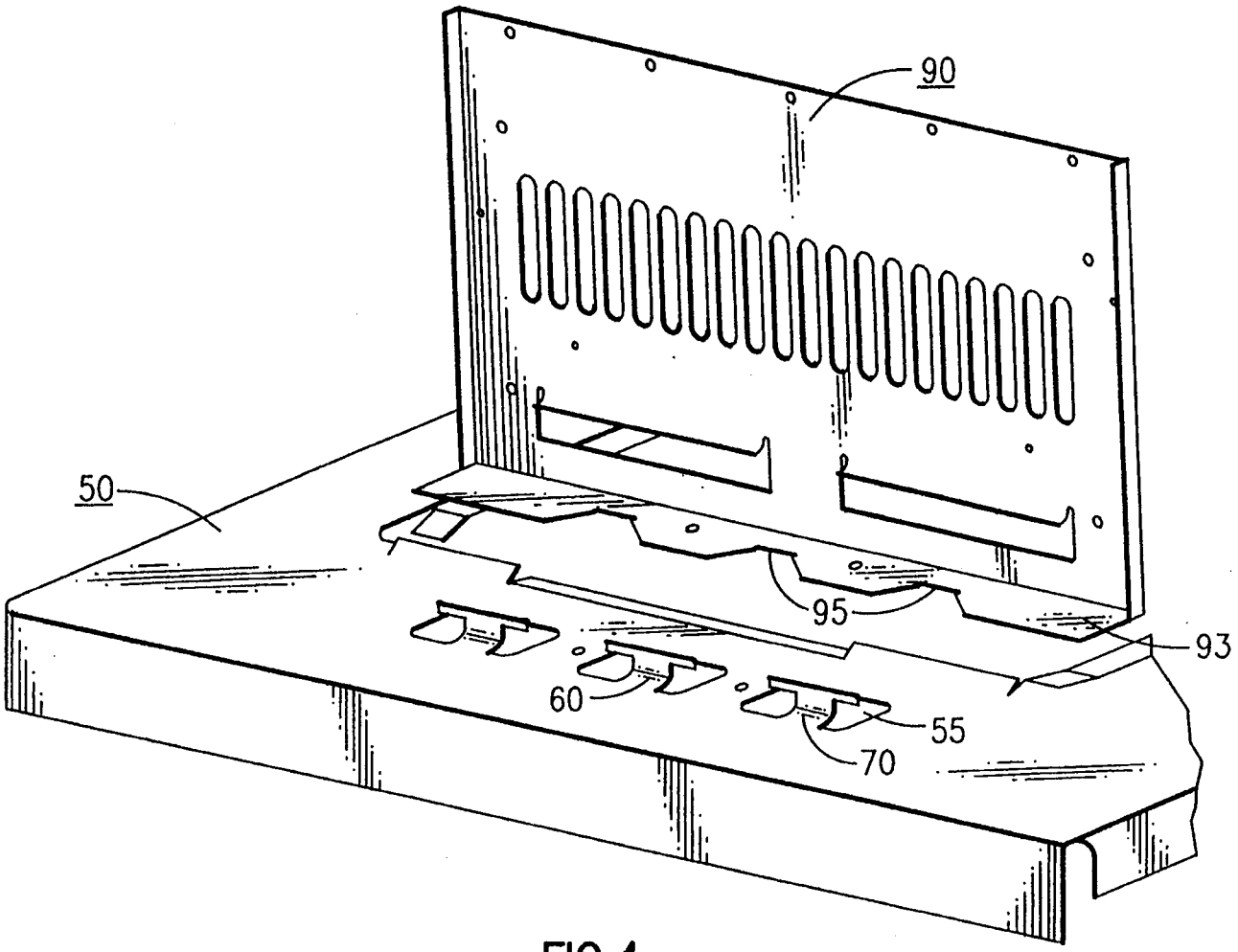
FIG. 4 is a view of the instant invention showing the blower shelf disengaged from the heat exchanger assembly back panel.

The connection between the blower shelf 50 and the heat exchanger and panel assembly 20 is shown further in FIGS. 2, 3 and 4. Specifically, the connection exists between blower shelf 50 and back panel 90 of panel assembly 20.

Figure 5:
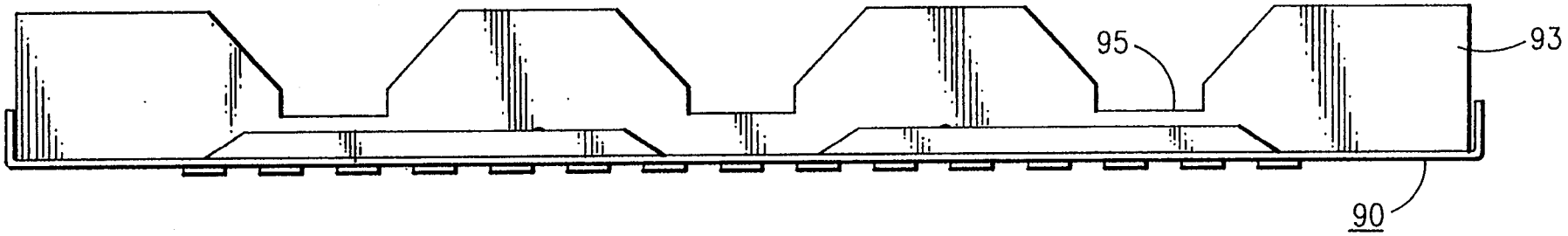
FIG. 5 is a top view of the heat exchanger assembly back panel of the instant invention, showing the "Y" shaped cuts in the flange thereof.

Turning, now to FIGS. 3, 4 and 5, it can be seen that the back panel 90 has extending flange 93 inwardly therefrom so that it is perpendicular to the back panel 90 and parallel to and, in the upflow orientation immediately above and in contact with the blower shelf 50. Cut from the flange 93 are "Y" shaped slots 95 having short wide bases and with both branches of the "Y" being completely contiguous with one another. These are positioned with the base of each "Y" facing the back panel 90.

Figure 7:
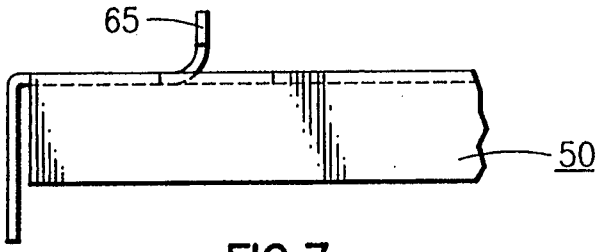
FIG. 7 is a side view of the shelf of FIG. 6 showing the turned up "T" shaped tabs.
Figure 6:
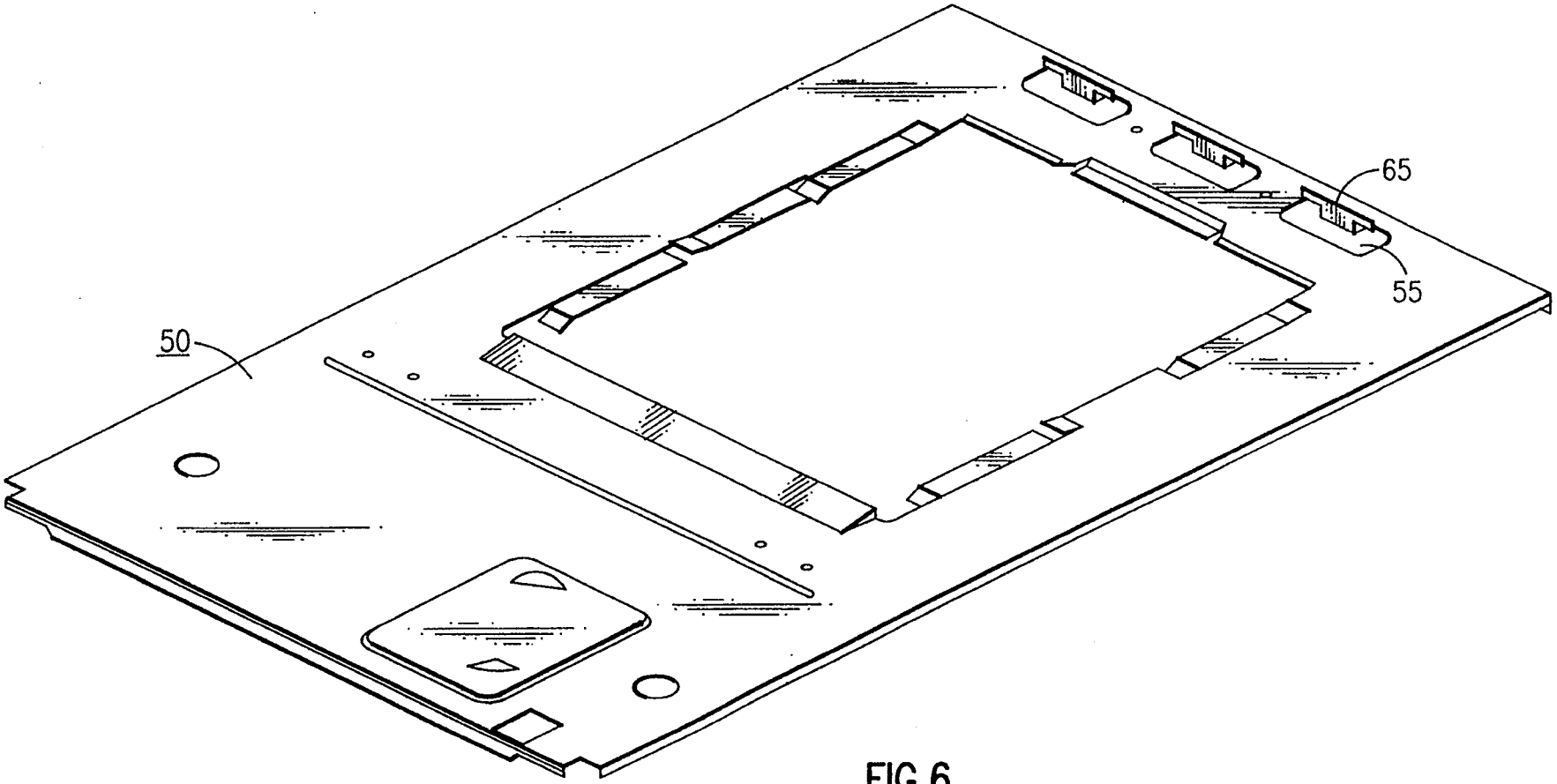
FIG. 6 is a perspective view of the blower shelf of the instant invention.

Turning, next to FIGS. 6 and 7, it is shown that the blower shelf 50 has incised into its surface, proximate the back end, a series of "U" shaped holes 55 corresponding in position to the "Y" shaped slots 95 of the back panel 90. The base of the "U" of these holes faces the front of the blower shelf 50. Extending into each "U", and forming the non-incised portion thereof is a tab stem 60 which forms the base of a "T" shaped tab 65. The crossbar 70 of the "T" shaped tab 65 is bent perpendicularly out of the plane of the blower shelf 50, and upward from the shelf 50 when the furnace is in an upflow orientation.

Returning now to FIGS. 3 and 4 it can be seen that the shelf 50 is easily attached to the back panel 90 by sliding the shelf 50 toward the back panel 90 so that the plane of the flange 93 is parallel to, slightly above, and touching that of the shelf 50, and so that the bottom 70 of each "T" crossbar 70 passed across the edges of the corresponding "Y" slot. When fully engaged the stem 60 of each "T" of the shelf 50 supports the base of the corresponding "Y" of the back panel.

It can be seen that this connection is stable in either the up or the down orientation. In the upflow orientation the heat exchanger assembly 20 rests on the blower shelf 50 with flanges 93 resting on shelf 50 and supported in position by "T" shaped tab 65. In the downflow and horizontal positions the heat exchanger assembly 20 hangs down from the blower shelf 50; in downflow the shelf 50 rests on flanges 93 and in the side orientations flanges 93 are supported by the sides of the "T"s 65.

Furthermore the heat exchanger assembly 20 is easily detached from blower shelf 50 by sliding the assembly 20 slightly toward the rear of the furnace so that the stem 60 of the "T" slips out of the cutout "Y" in flange 93, and then lifting it upward for removal. The retaining means of the back panel 90 is unitary with back panel 90 and the mating means of blower shelf 50 is unitary with blower shelf 50.

In the preferred embodiment flange 93 contains three "Y" shaped cut-outs and blower shelf 50 contains three "T" shaped bent tabs 65, but this number is not critical to the instant invention as any number of corresponding elements which will securely retain the shelf 50 against the back panel 90 is acceptable. Nor is the exact shape of the tab 65 and slot 90 critical. All that is required is that the tabs have a neck portion that is sufficiently narrow to slip into the slot and a free end portion sufficiently wide to overlap the blower shelf on either side of the slot.

While this invention has been explained with reference to the structure disclosed herein, it is not confined to the details set forth and this application is intended to cover any modifications and changes as may come within the scope of the following claims:

What is claimed is:

1. In a furnace of the type having a blower shelf with a blower attached to a first surface of said blower shelf and a heat exchanger unit located proximate a second surface of said blower shelf, and a back panel of said heat exchanger unit, reversibly attached to said blower shelf, the improvement comprising:

a retaining means unitary with said back panel of said heat exchanger; and a mating means unitary with said blower shelf wherein said retaining means and mating means function jointly to retain said panel perpendicular to and proximate said blower shelf.

2. The apparatus according to claim 1 wherein said furnace is further capable of operating in one of the group of orientations of upflow, downflow, horizontal-right flow, and horizontal-left flow and said retaining means and mating means function jointly to retain said surface of said heat assembly panel in a stable position in any of said orientations.

3. The apparatus according to claim 2 wherein said retaining means comprises a flange that is bent perpendicularly to said back panel of said heat exchanger unit, said flange having at least one slot, said at least one slot having a base, and opening outwardly; and said mating means comprises at least one tab corresponding in position to said at least one slot, wherein said at least one tab has a neck and a free end portion, and said at least one tab is bent perpendicularly to said blower shelf, and said tab neck is at least as narrow the base of said at least one slot, and the free end portion of said at least one tab is wider than the base of said at least one slot.

4. The apparatus according to claim 3 wherein said at least one slot is "Y" shaped and said at least one tab is "T" shaped.

5. The apparatus according to claim 3 wherein said blower shelf contains three slots and said back panel contains three tabs.

* * * * *